US007880581B2

(12) United States Patent
Chang

(10) Patent No.: US 7,880,581 B2
(45) Date of Patent: Feb. 1, 2011

(54) PTC THERMISTOR

(76) Inventor: Chung-Tai Chang, No. 149, (Room 9, 10/F.) Lin Sen Road, Sec. 1, Tainan (TW) 701

( * ) Notice: Subject to any disclaimer, the term of this patent is extended or adjusted under 35 U.S.C. 154(b) by 380 days.

(21) Appl. No.: 12/283,499

(22) Filed: Sep. 15, 2008

(65) Prior Publication Data

US 2010/0066481 A1 Mar. 18, 2010

(51) Int. Cl.
*H01C 7/10* (2006.01)

(52) U.S. Cl. ..... 338/22 R; 338/226; 338/260; 219/505; 219/540

(58) Field of Classification Search ..... 338/22 R, 338/220, 226, 230, 268, 260, 315, 333; 219/505, 219/539–541, 549
See application file for complete search history.

(56) References Cited

U.S. PATENT DOCUMENTS

| | | | | |
|---|---|---|---|---|
| 4,401,885 | A * | 8/1983 | Ishii et al. | 219/523 |
| 4,814,584 | A * | 3/1989 | Bohlender et al. | 219/535 |
| 4,937,435 | A * | 6/1990 | Goss et al. | 219/528 |
| 5,028,763 | A * | 7/1991 | Chang | 219/530 |
| 5,410,298 | A * | 4/1995 | Wiseman | 340/610 |

* cited by examiner

*Primary Examiner*—Kyung Lee

(57) ABSTRACT

A PTC thermistor includes two electric conducting plates connected with different electrodes and an intermediate insulating plate clamped between the two electric conducting plates. The intermediate insulating plate has its surface bored with openings at locations respectively corresponding with those of each PTC thermal resistance member for the PTC thermal resistance member to be engaged therein. The intermediate insulating plate can surely separate and insulate the two different-electrode electric conducting plates and stably fix the PTC thermal resistance members in position.

4 Claims, 7 Drawing Sheets

PTC THERMISTOR

BACKGROUND OF THE INVENTION

1. Field of the Invention

This invention relates to a PTC thermistor, particularly to one able to surely separate and insulate two electric conducting plates with different electrodes positioned inside the PTC thermistor, able to insure safety when the PTC thermistor makes electrical connection.

2. Description of the Prior Art

A conventional PTC thermistor disclosed in a U.S. Pat. No. 5,125,070, titled "PTC THERMISTOR" (Positive Temperature Coefficient Thermistor), which is devised by the inventor of this invention, as shown in FIGS. 1, 2 and 3, includes a plurality of beehive-shaped PTC thermal resistance members 10, two metal conducting plates 11, 12, two insulating plates 13 and two heat-conducting plates 15.

The beehive-shaped PTC thermal resistance members 10 are provided in the center of the PTC thermistor, and the two metal conducting plates 11, 12 are respectively positioned at the opposite sides of the PTC thermal resistance members 10, having their surfaces respectively bored with a plurality of openings 110, 120 at locations respectively aligned to each PTC thermal resistance member 10. Each opening 110 of the conducting plate 11 has its inner wall protruding out and forming wing strips separated and formed with positioning recesses 111 tallying with one side area of each PTC thermal resistance member 10, while each opening 120 of the conducting plate 12 has its inner wall formed integral with elastic strips 121 protruding toward the other side of the PTC thermal resistance member 10. The two insulating plates 13 with plural openings are respectively disposed at the outer side of the two conducting plates 11 and 12. After foresaid components of the conventional PTC thermistor are combined together, the power-connecting terminal 112 and 122 of the conducting plate 11, 12 are respectively connected with a power source to let the opposite sides of the PTC thermal resistance members 10 electrically connected and heated to produce a heat source, and then wind generated by a fan blows toward the PTC thermistor to exhaust out the heat of the PTC thermal resistance members 10 through the openings 110, 120 of the conducting plate 11, 12 and the openings of the two insulating plates 13. In addition, to avoid overheat of the two conducting plates 11, 12 due to contact with the two sides of the PTC thermal resistance members 10, the conventional PTC thermistor is additionally provided with two heat-conducting plates 15 respectively positioned between the conducting plates 11 and 12 and the insulating plate 13 to contact with the conducting plates 11 and 12 for dispersing high temperature of the two conducting plates 11, 12.

After the conventional PTC thermistor is assembled, as shown in FIGS. 2 and 3, the PTC thermal resistance members 10 are firmly clamped between the two electric conducting plates 11, 12, and the two heat-conducting plates 15 and the two insulating plates 13 are respectively and orderly disposed at the outer side of the conducting plate 11, 12, and then all the components are combined together by the locking members 14. Thus, each PTC thermal resistance member 10 has one side engaged in the positioning recesses 111 of the first conducting plate 11 and the other side held by the elastic strips 121 of the second conducting plate 12, letting the PTC thermal resistance members 10 closely clamped by the two conducting plates 11 and 12. The power-connecting terminals 112 and 122 of the electric conducting plates 11 and 12 are respectively connected with a positive electrode and a negative electrode, and when electrically connected, the opposite sides of the PTC thermal resistance members 10 will immediately be heated to form a heat source.

However, in the conventional PTC thermistor, the electric conducting plates 11 and 12 respectively connected with a positive and negative electrode are separated only by the PTC thermal resistance members that are formed with a little thickness and arranged separately; therefore, the two electric conducting plates 11 and 12 with different electrodes are spaced apart only with a small gap to lower their insulation effect. Moreover, if the locking members 14 employed for combining the components are respectively locked with uneven tightness to shorten the distance between the two electric conducting plates 11 and 12, the two conducting plates 11, 12 will lose insulation effect and most likely to contact with each other and cause short current, resulting in a danger. In addition, the PTC thermal resistance members 10 are clamped and fixed between the two conducting plates 11 and 12 by having one side a only a little inserted in the shallow positioning recesses 111 of the first conducting plate 11 and the other side supported by the elastic strips 121 of the second conducting plate 12. Thus, the PTC thermal resistance members 10 are easy to slip off because the positioning recesses 111 of the first conducting plate 11 are not deep enough to hold them tight.

SUMMARY OF THE INVENTION

This invention is devised to offer a PTC thermistor able to surely separate and insulate two electric conducting plates that are connected with different electrodes, able to insure safety in use.

The feature of this invention is an intermediate insulating plate clamped between the two electric conducting plates. The intermediate insulating plate has its surface disposed with plural openings at locations respectively corresponding with those of each PTC thermal resistance member for the PTC thermal resistance member to be engaged therein. The intermediate insulating plate can surely separate and insulate the two electric conducting plates and stably fix the PTC thermal resistance members in position.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
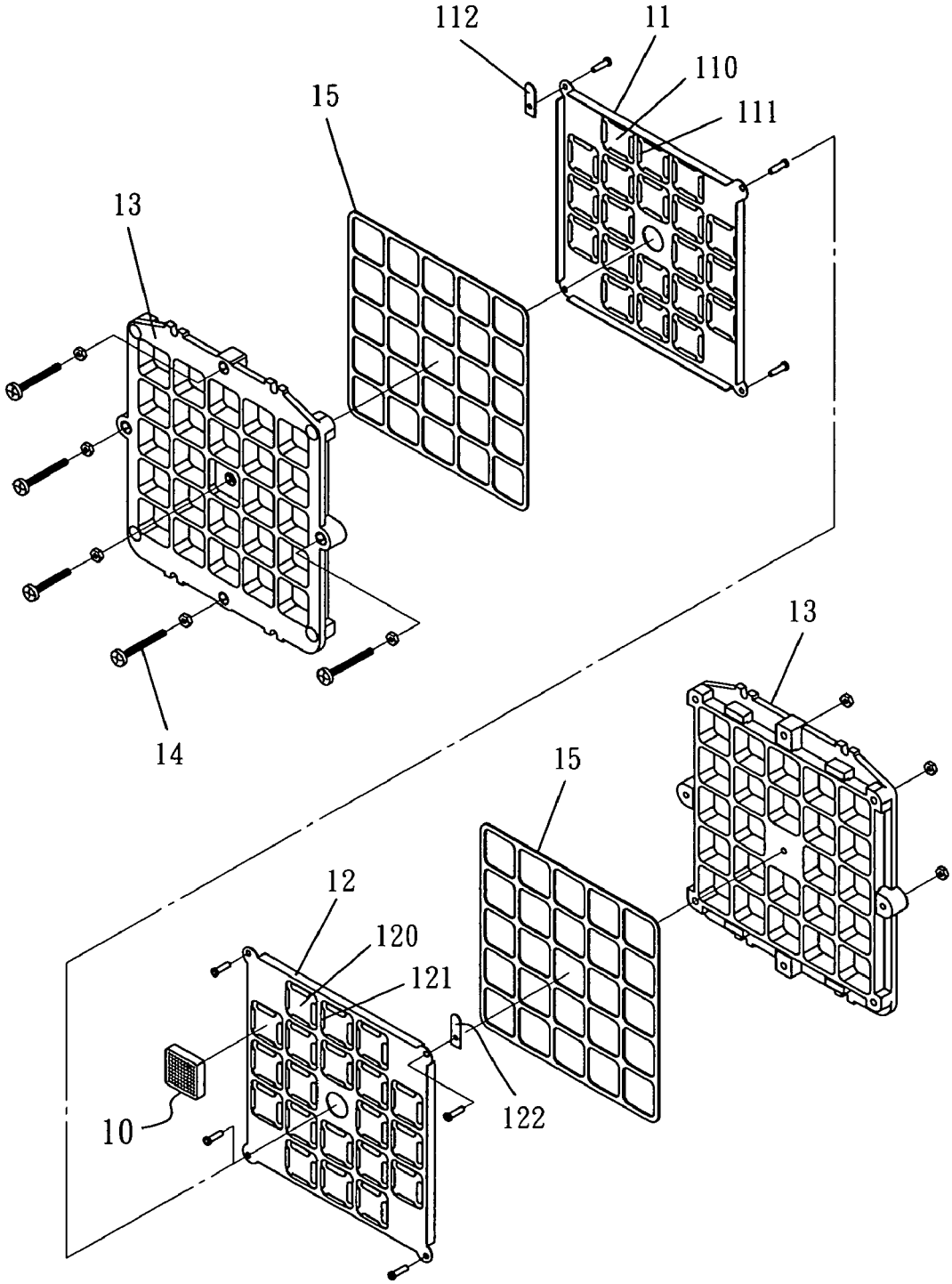
FIG. 1 (PRIOR ART)
FIG. 1 is an exploded perspective view of a conventional PTC thermistor.
Figure 2:
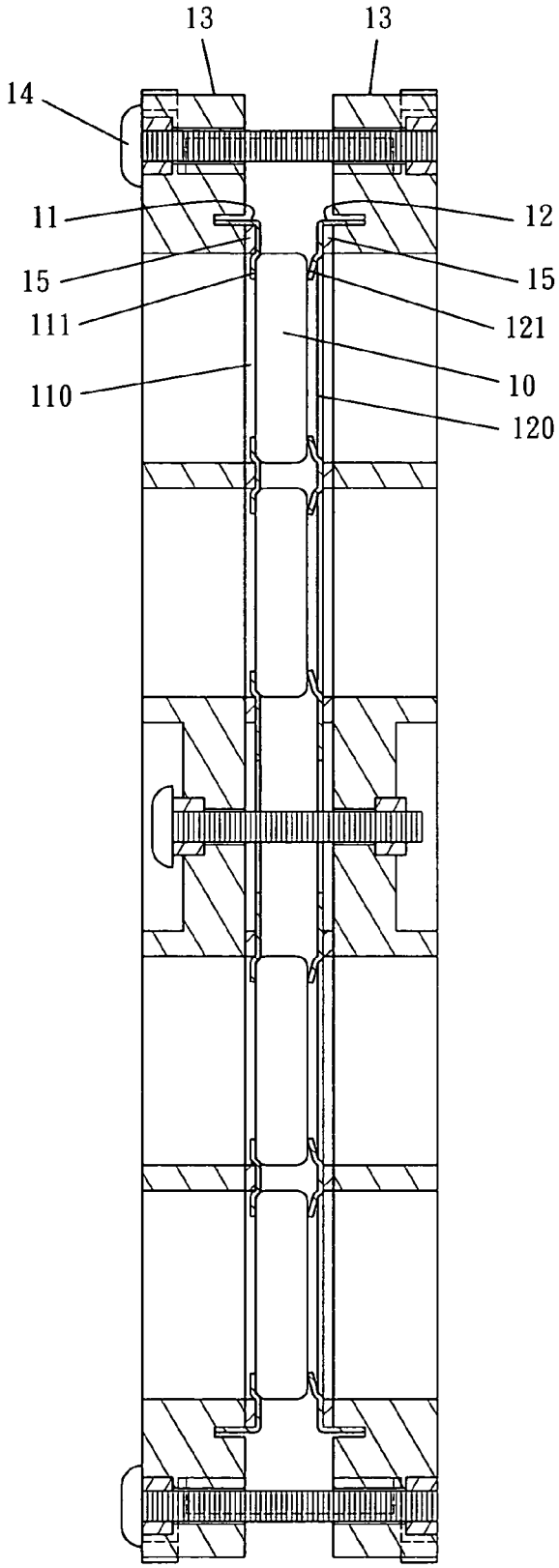
FIG. 2 (PRIOR ART)
FIG. 2 is a cross-sectional view of the conventional PTC thermistor.
Figure 3:
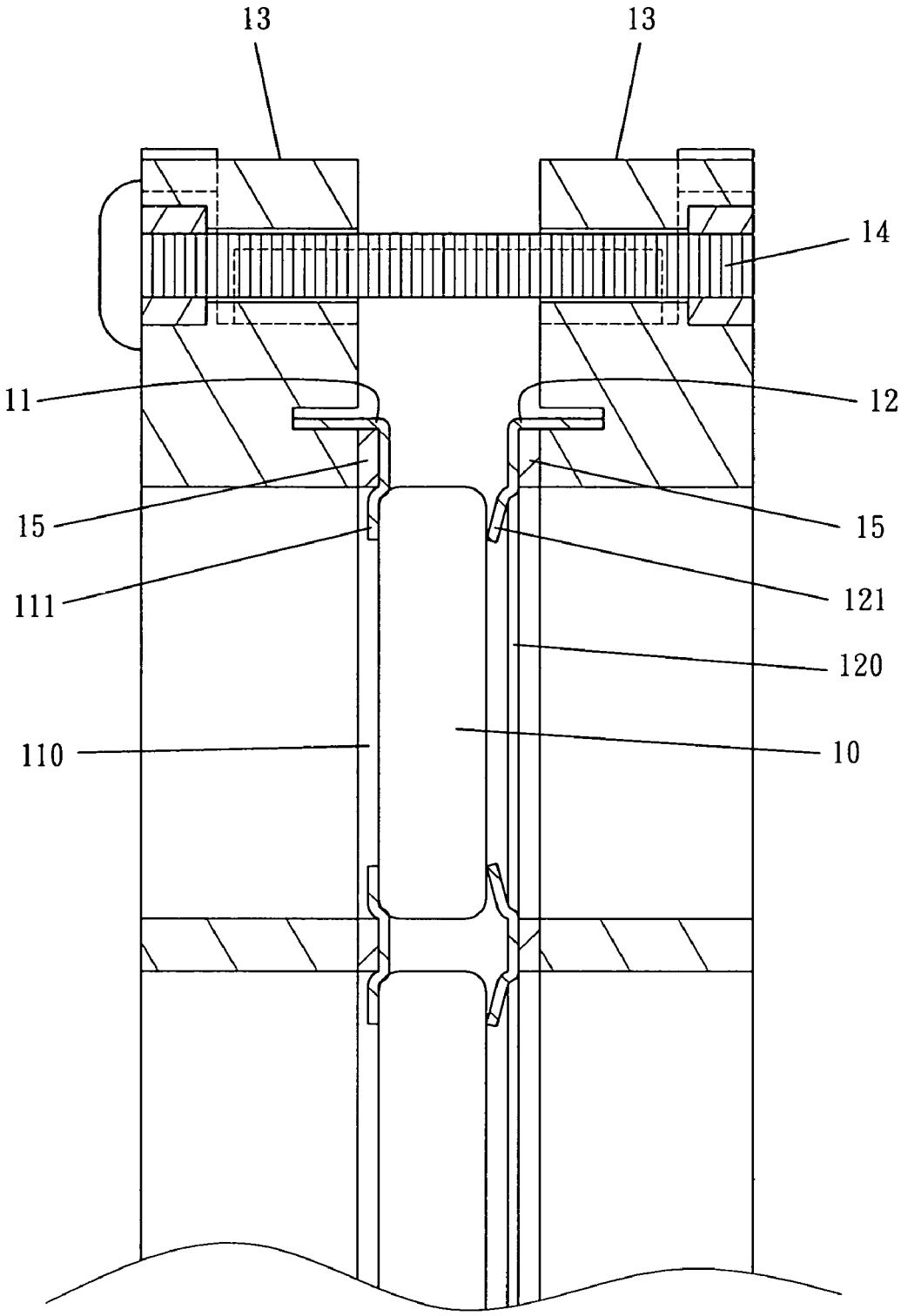
FIG. 3 (PRIOR ART)
FIG. 3 is a partial magnified cross-sectional view of FIG. 2.

A preferred embodiment of a PTC thermistor in the present invention, as shown in FIGS. 4-7, includes a plurality of PTC thermal resistance members 20, two electric conducting plates 21 and 22, two heat-conducting plates 23, two outer insulating plates 24, plural locking members 25 and an intermediate insulating plate 26 as main components combined together.

The PTC thermal resistance members 20 are respectively formed with beehive holes in the central portion, functioning to be a heat source after the opposite sides are electrically connected and heated.

Figures 4, 5, 6:
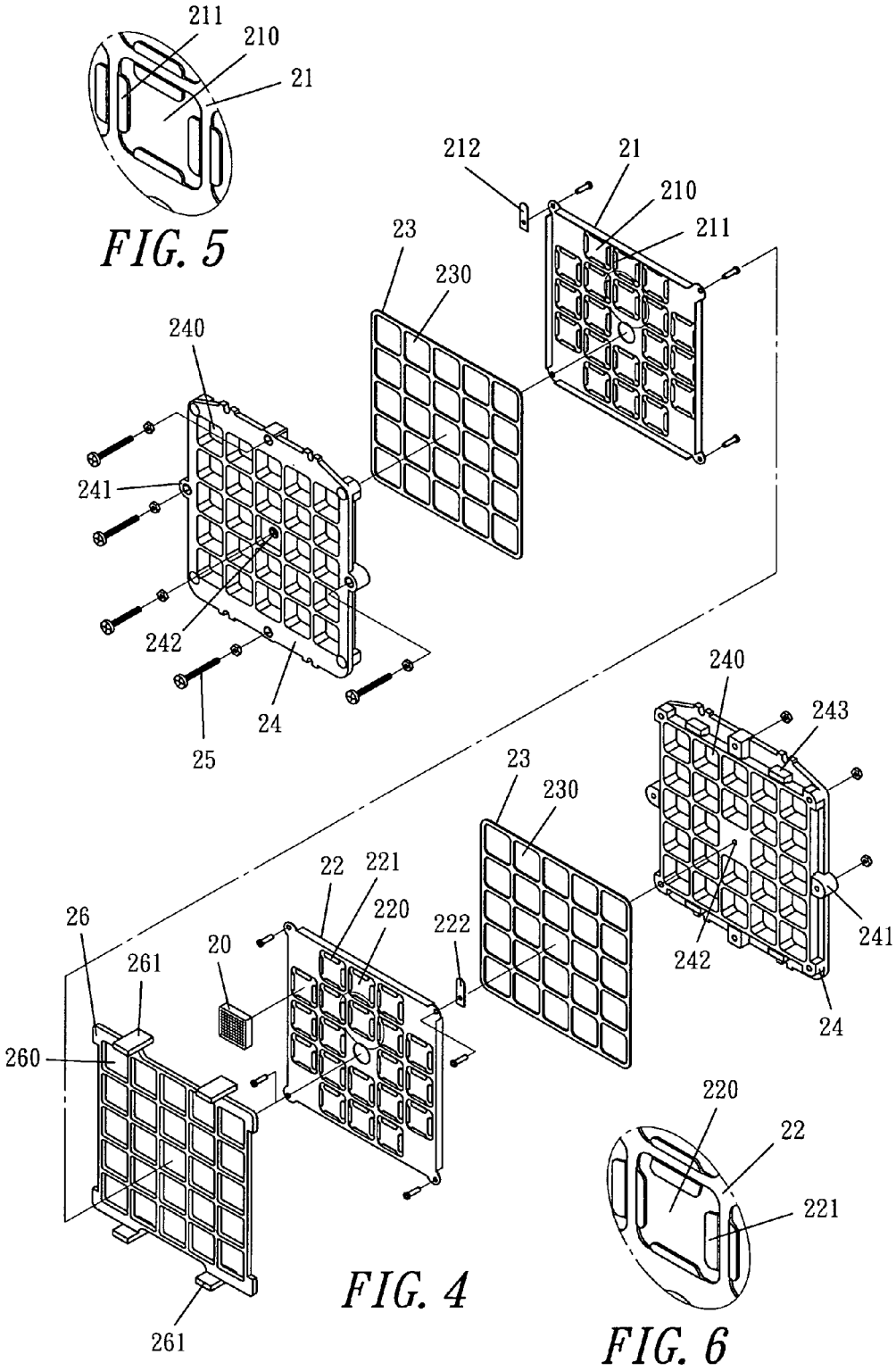
FIG. 4 is an exploded perspective view of a PTC thermistor in the present invention.
FIG. 5 is a partial magnified view of FIG. 4.
FIG. 6 is another partial magnified view of FIG. 4.

The two electric conducting plates 21 and 22 with electric conductivity have their surfaces respectively bored with lots of openings 210, 220 at locations respectively corresponding with each PTC thermal resistance member 10. Each opening 210 of the first electric conducting plate 21 has its inner wall protruding and forming wing strips spaced apart and formed with positioning recesses 211 matching with one side area of the PTC thermal resistance member 20, as shown in FIG. 5, while each opening 220 of the second electric conducting plate 22 has its inner wall formed integral with elastic strips 221 extending toward the other side of the PTC thermal resistance member 20, as shown in FIG. 6. Thus, after the PTC thermal resistance member 20 has one side engaged in the positioning recesses 211 of the first electric conducting plate 21 and the other side supported by the elastic strips 221 of the second electric conducting plate 22, the PTC thermal resistance members 20 can be firmly fixed between the two electric conducting plates 21 and 22. Further, after the power-connecting terminal 212 and 222 of the electric conducting plate 21 and 22 are respectively connected with a positive and a negative electrode of a power source, the opposite sides of the PTC thermal resistance members 20 will be electrically connected and heated.

The two heat-conducting plates 23 with heat conductivity are respectively stuck to the outside of the two electric conducting plates 21 and 22 so that heat of the two electric conducting plates 21 and 22 due to touching the PTC thermal resistance members 20 can be transmitted to the two heat-conducting plates 23 for lowering the temperature of the two electric conducting plates 21 and 22. The two heat-conducting plates 23 have their surfaces respectively bored with plural openings 230 at locations respectively matching with those of each PTC thermal resistance member 20 for exhausting out heat produced by the PTC thermal resistance members 20.

The two outer insulating plates 24 made of heat-resisting and non-conducting material, such as PPS or nylon mixed with glass fiber, are respectively positioned at the outer side of the two heat-conducting plates 23, respectively having the surface formed with plural openings 240 at locations respectively aligned to those of each PTC thermal resistance member 20. Further, the two outer insulating plates 24 respectively have the outer peripheral edge fixed thereon with plural slotted lugs 241 spaced apart and the center of its surface bored with an insert hole 242.

The locking members 25 are respectively inserted through the lugs 241 and the insert holes 242 of the two outer insulating plates 24 for tightly combining foresaid components together.

Figure 9:
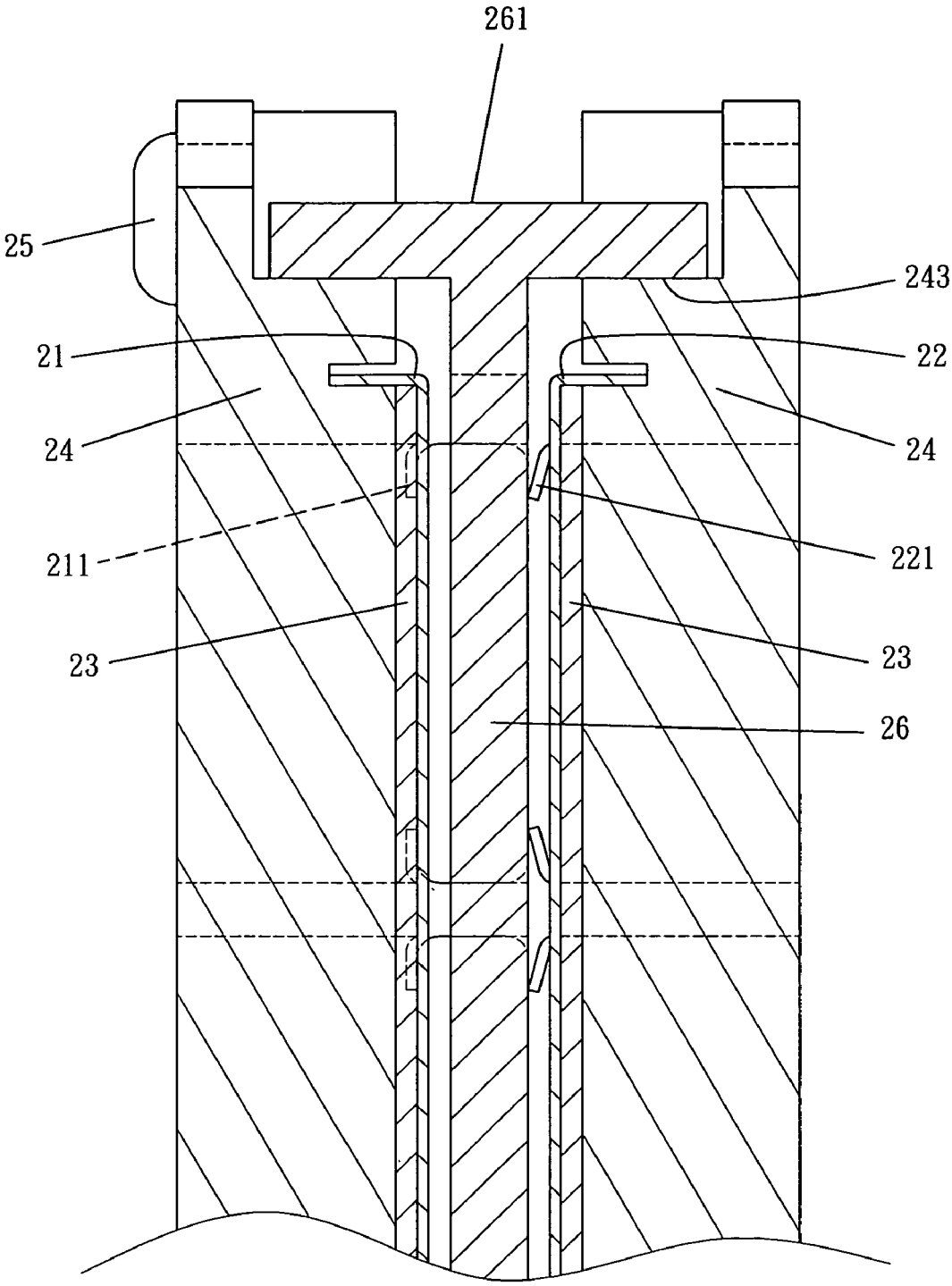
FIG. 9 is a partial cross-sectional view of the PTC thermistor in the present invention.

The intermediate insulating plate 26, as shown in FIG. 4, is a heat-resisting and electrically insulating plate disposed between the two electric conducting plates 21 and 22, having its surface disposed with a plurality of openings 260 at locations respectively corresponding with those of each PTC thermal resistance member 20 for the PTC thermal resistance members 20 to be respectively inserted therein. The intermediate insulating plate 26 further has the opposite sides of its upper and its lower outer edge respectively secured with a holding member 261 having its opposite ends respectively extending outward to form a jutting portion to be held on the shoulder 243 at the outer edge of the two outer insulating plates 24 to avoid the intermediate insulating plate 26 sliding, as shown in FIGS. 4 and 9.

Figure 7:
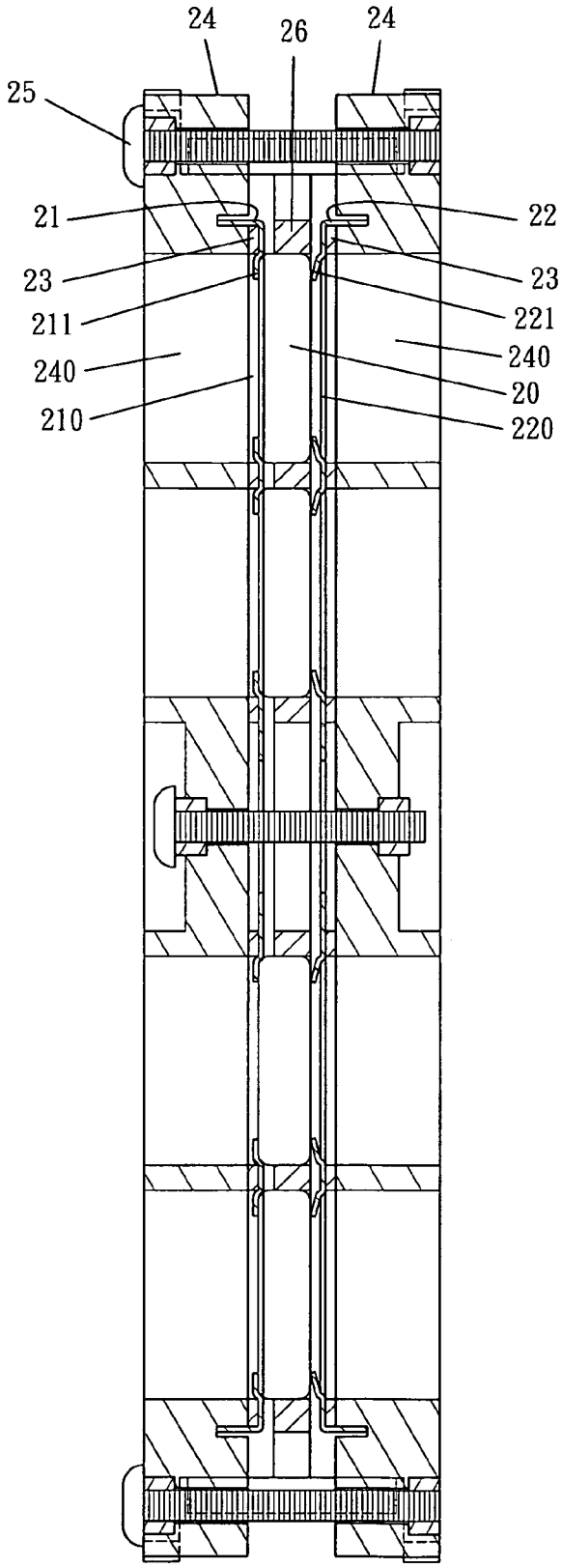
FIG. 7 is a cross-sectional view of the PTC thermistor in the present invention.
Figure 8:
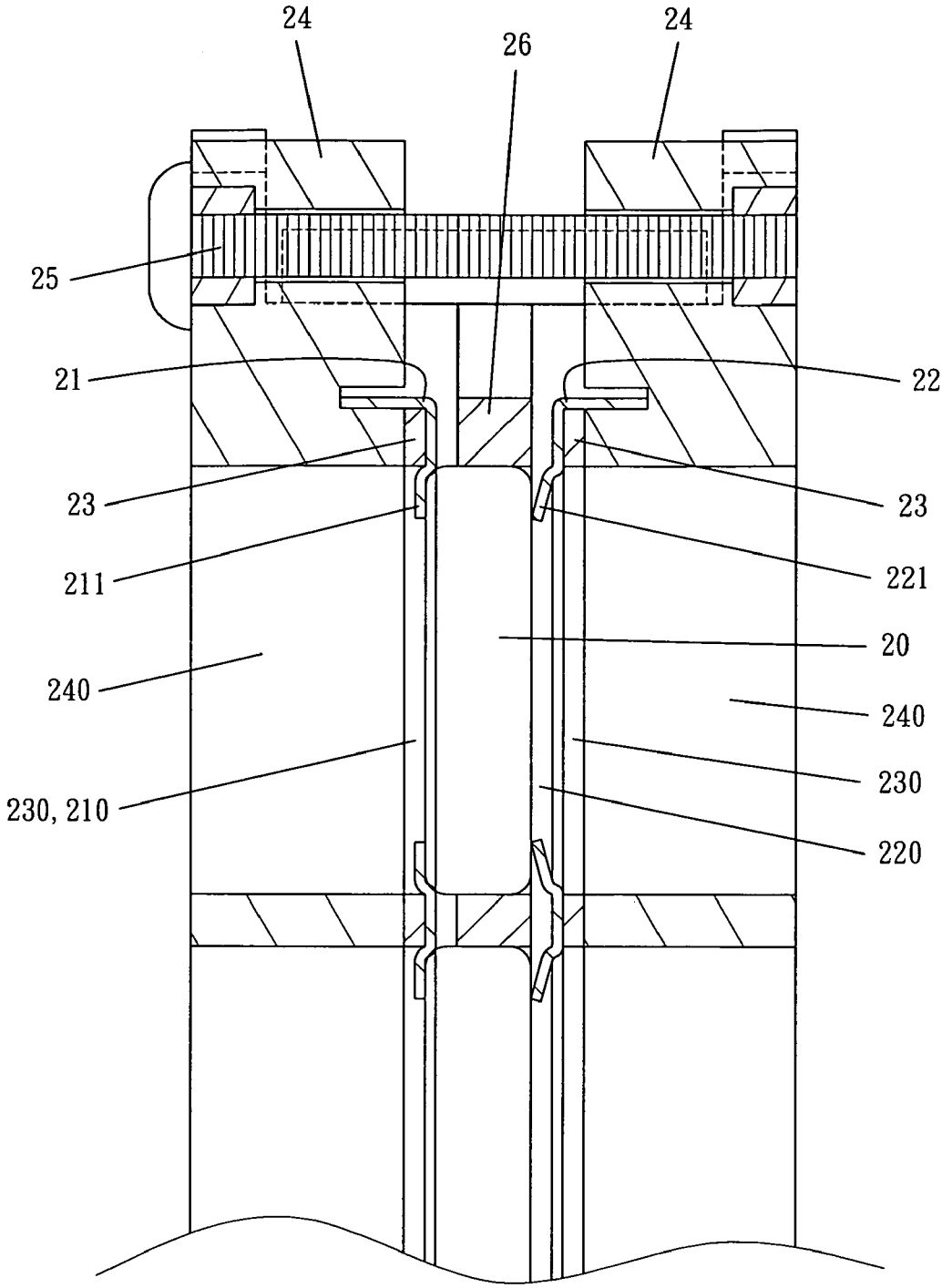
FIG. 8 is a partial magnified view of FIG. 7.

After foresaid components are orderly combined together, as shown in FIG. 7, the two electric connecting plates 21 and 22 have their power-connecting terminal 212, 222 respectively connected with a positive and a negative electrode to let the opposite sides of the PTC thermal resistance members 20 make electrical connection to produce heat and form a heat source. Simultaneously, heat produced by the PTC thermal resistance members 20 will flow out through the openings 210, 220 of the two electric conducting plates 21, 22 and the openings 230 of the two heat-conducting plates 23 and through the openings 240 of the two outer insulating plates 24. Being located between the two electric conducting plates 21 and 22, the insulating and heat-resisting intermediate insulating plate 26 can surely separate the two different-electrode electric conducting plates 21, 22 so as to insure insulation effect of the two electric conducting plates 21, 22. In addition, the intermediate insulating plate 26 has its surface bored with openings 260 for the PTC thermal resistance members 20 to be respectively engaged therein; therefore, the PTC thermal resistance members 20 can be assembled with great stability.

As can be understood from the above description, this invention has the following advantages and efficacies.

1. The two electric conducting plates are separated from each other by the intermediate insulating plate, able to insure insulation effect of the two electric conducting plates.

2. The PTC thermal resistance members can be stably fixed in position.

While the preferred embodiment of the invention has been described above, it will be recognized and understood that various modifications may be made therein and the appended claims are intended to cover all such modifications that may fall within the spirit and scope on the invention.

I claim:

1. A PTC thermistor comprising:

plural PTC thermal resistance members respectively having a central portion formed with beehive holes;

two electric conducting plates with electric conductively respectively connected with different electrodes, said PTC thermal resistance members clamped between said two electric conducting plates, said two electric conducting plates having their surfaces bored with plural openings at locations respectively corresponding with those of each said PTC thermal resistance member;

two outer insulating plates made of insulating and heat-resisting material, said two outer insulating plates respectively positioned at an outer side of said two electric conducting plates, said two outer insulating plates having their surfaces respectively disposed with openings at locations respectively matching with those of each said PTC thermal resistance member; and plural locking members employed to be inserted through said two outer insulating plates to lock them together for tightly combining foresaid components; and characterized by an intermediate insulating plate having insulating and heat-resisting property and positioned between said two electric conducting plates, said intermediate insulating plate having its surface bored with openings at locations respectively aligned to those of each said PTC thermal resistance member for said PTC thermal resistance member to be inserted therein.

2. The PTC thermistor as claimed in claim 1, wherein said intermediate insulating plate has two sides of its two opposite outer edges respectively fixed thereon with a holding member having its opposite ends respectively protruding out and forming a jutting portion, said jutting portion held on a shoulder at an outer edge of said two outer insulating plates to prevent said intermediate insulating plate from sliding.

3. The PTC thermistor as claimed in claim 1, wherein two heat-conducting plates are respectively disposed at an outer side of said two electric conducting plates, said two heat-conducting plates with heat conductivity are respectively stuck on said two electric conducting plates so that high temperature of said two electric conducting plates, produced by touching said PTC thermal resistance members, can be transmitted to said heat-conducting plates to lower temperature of said electric conducting plates, said two heat-conducting plates having their surfaces respectively disposed with plural openings at locations respectively tallying with those of each said PTC thermal resistance member for exhausting out heat produced by said PTC thermal resistance members.

4. The PTC thermistor as claimed in claim 1, wherein each opening of one said electric conducting plate has its inner wall provided with positioning recesses spaced apart and matching with one side area of each said thermal resistance member, and each said opening of another said electric conducting plate has its inner wall formed integral with elastic strips protruding toward another side of each said thermal resistance member, said thermal resistance member having one side engaged in said positioning recesses of said one electric conducting plate and another side propped by said elastic strips of said another electric conducting plate to have both sides firmly fixed in position.

* * * * *